United States Patent [19]

Scott, Jr.

[11] 4,149,483

[45] Apr. 17, 1979

[54] AQUATIC MANEUVERING DEVICE

[76] Inventor: John W. Scott, Jr., 220 W. 5th St., Los Angeles, Calif. 90013

[21] Appl. No.: 831,405

[22] Filed: Sep. 8, 1977

[51] Int. Cl.[2] ..... B63G 8/00

[52] U.S. Cl. ..... 114/332; 114/330

[58] Field of Search ..... 114/16 R, 16 A, 16 F, 114/332, 330, 315, 312; 115/6.1; 244/83 C; 9/310 E

[56] References Cited

U.S. PATENT DOCUMENTS

| | | | |
|---|---|---|---|
| 1,869,326 | 7/1932 | Ludlow | 244/83 C |
| 3,163,148 | 12/1964 | Duren | 114/16 A |
| 3,255,723 | 6/1966 | Teetor | 114/16 A |
| 3,638,598 | 2/1972 | Vlad | 114/16 A |
| 3,931,777 | 1/1976 | Colgan | 114/16 A |

*Primary Examiner*—Trygve M. Blix
*Assistant Examiner*—D. W. Keen

[57] ABSTRACT

A device to be towed through the water by a boat and which in turn is adapted to tow a person through the water, the body of the device having a constant buoyancy and being equipped with steering means whereby it can be maintained on the surface of the water while being towed, can be submerged while towing a person with scuba gear, and which can be maneuvered under water to partially or completely roll the device and its user.

1 Claim, 1 Drawing Figure

AQUATIC MANEUVERING DEVICE

FIELD OF THE INVENTION

The device is particularly adapted for use in water sports, generally but not necessarily, by persons equipped with scuba gear which permits them to remain submerged for much longer periods of time than persons not so equipped. It can be towed on the surface of a body of water and the person using it grasps suitable handgrip means and he in turn is towed through the water by the device.

It can be directionally controlled so that it will submerge to appreciable depths while being towed and while under the surface it can be steered or maneuvered to partially or completely roll with its user.

It can be used by scuba divers in exploring the edges of kelp beds for fish to be taken with a fish spear device. When a school is located, the scuba diver can release the handgrips so that he will remain near the fish while the maneuvering device, by reason of its inherent constant buoyancy, will rise to the surface. The fact that the submerged user has released the device becomes apparent to the towing boat because of the sudden and quite pronounced lessening of drag.

The invention will become more apparent from the following description in connection with the accompanying drawing wherein.

Figure 1:
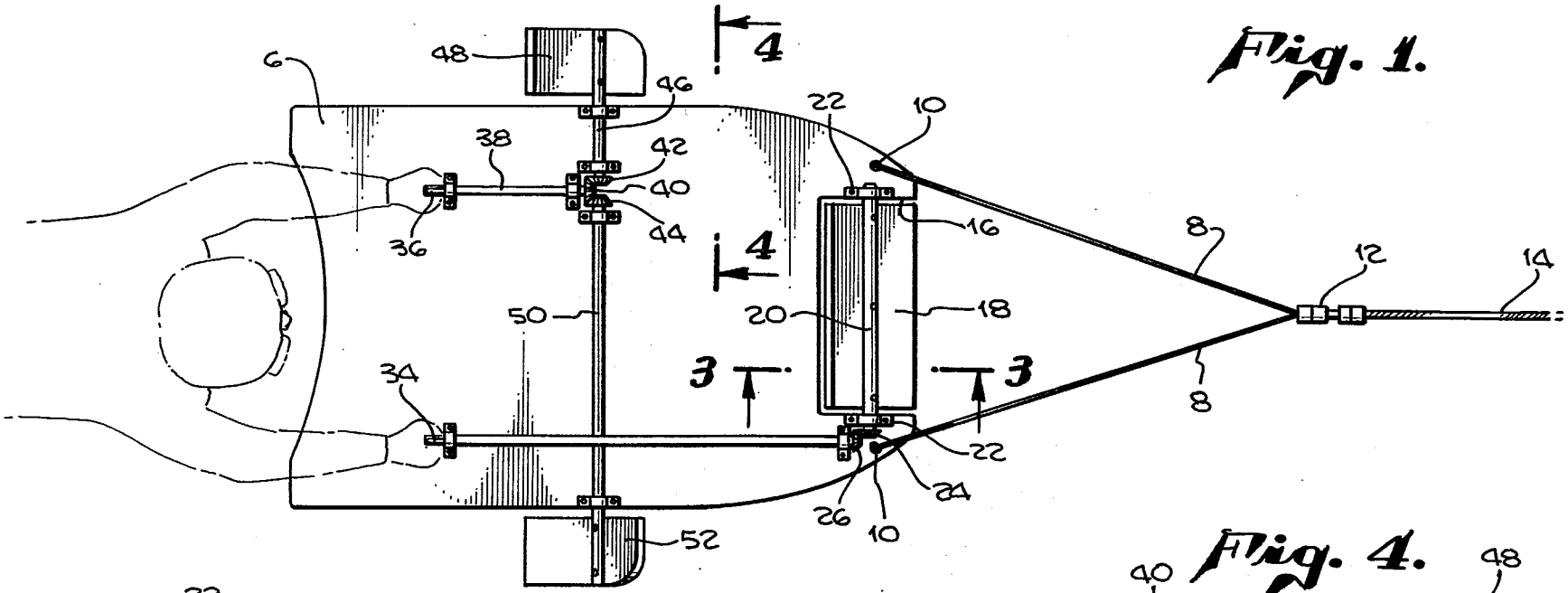
FIG. 1 is a plan view of an embodiment of the invention with portions of the diver indicated in broken lines.
Figure 4:
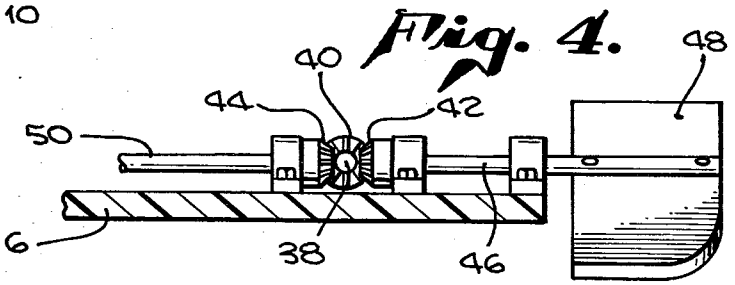
FIG. 4 is an enlarged section taken approximately on the line 4—4 of FIG. 1.
Figure 3:
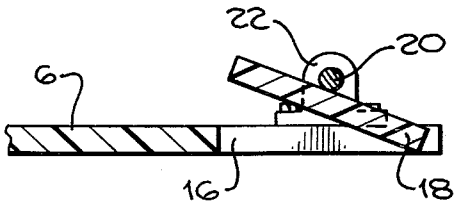
FIG. 3 is an enlarged section taken approximately on line 3—3 of FIG. 1.

The device includes a body 6 which as shown is wide and relatively thin and flat and is longer than its width. It may be made of any suitable material for use in water but it is preferred that it be of some material or construction which will give it a constant degree of buoyancy sufficient to raise it from beneath the surface of the water and float it upon the surface. It is preferred that the buoyancy be not much greater than that sufficient to float the device along in order that it can be submerged and maneuvered beneath the water without difficulty.

The body 6 is provided with a pair of cables 8 secured at the sides as at 10 and converging to be engaged by a swivel 12 to which a tow cable 14 can be attached, the tow cable being trailed from a power boat.

The front portion of the body 6 is provided with a rectangular cutout 16 to accommodate a combined submerging and surfacing vane 18, said vane being carried tiltably by a rod 20 mounted for rotation of movement between journals 22 adjacent the ends of the rectangular cutout 16.

The rod 20 on its right-hand as viewed in FIG. 1 is provided with a bevel gear 24 which meshes with a similar gear 26 on a rotatably mounted rod 28 supported between journals 30 and 32 along the right portion of the body 6. The rod 28 terminates in an upwardly disposed handgrip loop 34.

A second handgrip loop 36 is on the rear end of a shorter longitudinal rod 38 having a forward bevel gear 40 meshing with cooperating gears 42 and 44. Gear 42 is on the end of a shaft 46 whose opposite end extends laterally from the left side of the body 6 and supports a tiltable vane 48. Bevel gear 44 is on the left-hand of a longer rod 50 which extends across the body 6 and beyond the right edge thereof to tiltably support a vane 52 which is similar to the vane 48. However, it will be noted that the vanes 48 and 52 will be tilted in opposite directions upon rotating or partial rotation of the handgrip supporting rod 38.

Figure 2:
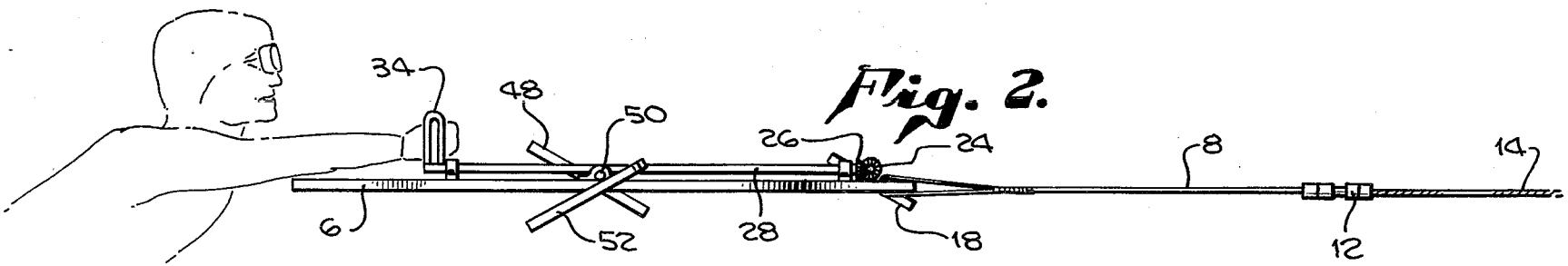
FIG. 2 is a side elevation view.

The handgrips 32 and 36 are disposed toward the rear of the buoyant body 6 so that they may be grasped as indicated by a person equipped preferably with scuba gear so that when the body 6 is being towed and the user in turn is being towed by the body, his head will be disposed beyond the rear edge of said body 6 so that he will have a view downwardly in the water behind the body. Also, as indicated in FIG. 2, when the diver looks up he can see forwardly above the towed body 6, a feature which is of advantage when submerged and, for example, observing kelp beds, or when surfaced, enabling him to see ahead to the towing boat and its occupants.

Ordinarily, scuba equipped fishermen dive from the surface along the edges of kelp beds in the hope of spotting fish to be speared. With the present device it is possible to maneuver upwardly and downwardly along the edge of the kelp and to follow its contours while being towed beneath the water until suitable quarry has been cited. Then the diver can merely release the handgrips, permitting the maneuvering device to be towed away and permitting him to remain near the fish he has sighted. The sudden lessening of drag on the tow line will indicate to those in the boat that the diver has released the maneuvering device and the boat can slow down or stop and the device will rise to the surface under its own fixed buoyancy.

It is preferred that the device had buoyance only sufficient to bring it to the surface reasonably quickly. It should not be too buoyant because it then becomes more difficult to maneuver downwardly below the surface. It should be noted that the present device differs from a variably submersible device such as a one man submarine in that the one man submarine has variable buoyancy to carry its occupant downwardly in the water whereas the present device, with not much more than minimal buoyancy, is maneuvered downwardly entirely by the diving action created by the forward vane 18 and not by a lessening of buoyancy of the device itself.

The side vanes 48 and 52 can be manipulated to cause the device to at least partially roll while being towed on the surface, but they are intended more for use below the surface where there opposite tilt can be utilized to cause the device and the diver to roll completely. Of course a partial roll can be executed and the device can be held in a vertical or other angular plane as it moves through the water.

The device is of simple construction and quite economical to manufacture. It has the capability of travel and maneuverability beneath the surface without requiring self-contained propulsion means. It can be towed by boats having much less power and speed than that required for ski-boats and therefore is open to use by a wide range of boat owners.

It should of course be understood that various changes can be made in the form, details, arrangement and proportions of the various parts without departing from the spirit of the invention.

What is claimed is:

1. An aquatic maneuvering device:

a planing surface unit providing low resistance to movement through a body of water, means associated with said planing surface unit for moving it through the water, a portion of said planing surface unit being angularly adjustable relative to other portions thereof to alter its planing effect and the direction of movement of the unit as a whole, handgrip means mounted on and relative to said planing surface unit, a connection between said handgrip means and said angularly adjustable portion of said planing surface unit to control the angularity thereof, said angularly adjustable portion comprising a vane at the forward medial portion of said unit, angularly adjustable means further comprising vanes at the sides of said unit, and the vanes at the sides of said unit being connected for simultaneous opposite angular movement.

* * * * *